United States Patent [19]

Greeves et al.

[11] Patent Number: 4,872,614

[45] Date of Patent: Oct. 10, 1989

[54] FUEL INJECTION NOZZLE

[75] Inventors: Godfrey Greeves, Hatch End; Robert J. Fry, Greenford, both of England

[73] Assignee: Lucas Industries Public Limited Company, Birmingham, England

[21] Appl. No.: 150,883

[22] Filed: Feb. 1, 1988

[30] Foreign Application Priority Data

Feb. 6, 1987 [GB] United Kingdom ..... 8702712

[51] Int. Cl.[4] ..... F02M 47/00

[52] U.S. Cl. ..... 239/533.9

[58] Field of Search ..... 239/533.2-533.12

[56] References Cited

U.S. PATENT DOCUMENTS

| | | | |
|---|---|---|---|
| 4,096,999 | 6/1978 | Eckert et al. | 239/533.5 |
| 4,537,359 | 8/1985 | Skinner | 239/533.4 X |
| 4,591,100 | 5/1986 | Gaskell et al. | 239/533.3 |

FOREIGN PATENT DOCUMENTS 581476 7/1933 Fed. Rep. of Germany .

*Primary Examiner*—Andres Kashnikow
*Assistant Examiner*—Kevin P. Weldon
*Attorney, Agent, or Firm*—Balogh, Osann, Kramer, Dvorak, Genova & Traub

[57] ABSTRACT

A fuel injection nozzle for supplying fuel to an internal combustion engine includes a valve member which at one end is of reduced diameter and mounts a spring abutment and at its other end is engageable with a seating to prevent flow of fuel from an inlet to an outlet. The valve member is slidable in a sleeve which is also slidable in a nozzle body secured to a holder. A spring is located in a chamber in the holder and the reduced diameter portion of the valve member extends into the chamber. A tubular push piece surrounds the reduced diameter portion to transmit the force developed on the sleeve by the fuel pressure, to the spring abutment. The movement of the sleeve is limited by the engagement of a flange on the push piece with the end face of the holder and the movement of the valve member is limited by the engagement of a step defined on the valve member with the end of the push piece.

1 Claim, 1 Drawing Sheet

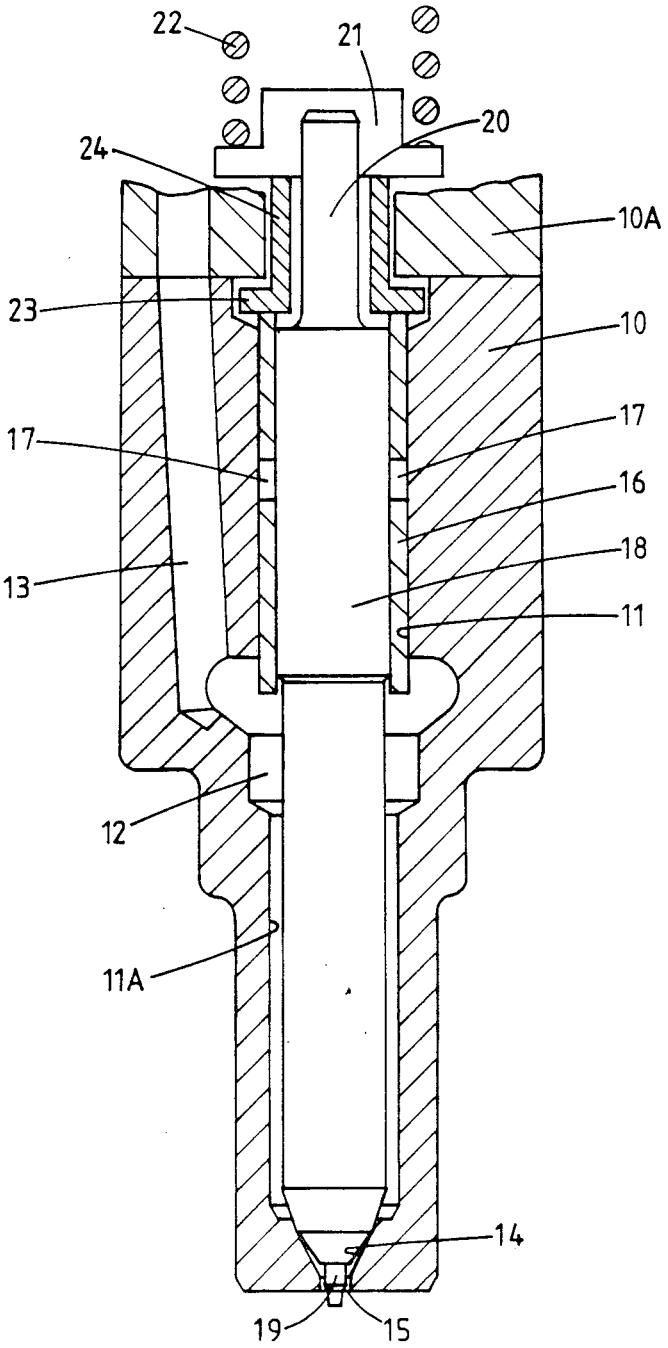
22
21
20
24
10A
23
10
17
17
16
18
13
11
12
11A
14
19
15

FUEL INJECTION NOZZLE

This invention relates to a fuel injection nozzle for supplying fuel to an internal combustion engine and of the kind comprising a valve member which is movable axially by fuel under pressure supplied through a nozzle inlet, away from a seating to permit fuel flow from the inlet to an outlet, the valve member being slidable within a sleeve which is itself axially slidable in a bore in a nozzle body and subjected to the fuel pressure at said inlet, resilient means biasing the valve member into contact with the seating, the fuel pressure acting on the sleeves serving to oppose the action of the resilient means and stop means for limiting the extent of movement of the sleeve.

A known form of such a nozzle is seen in British patent specification No. 1531580 and in FIG. 4 thereof the end surface of a distance piece, which is located between the nozzle body and a holder for the body, is machined to provide a stop surface for the sleeve and a separate stop surface is machined for the valve member the separate stop surface being formed intermediate the ends of an aperture in the distance piece and into which an extension of the valve member passes. The formation of the separate stop surface within the aperture poses manufacturing problems.

The object of the present invention is to provide an injection nozzle of the kind specified in a simple and convenient form.

According to the invention a nozzle of the kind specified comprises a holder to which the nozzle body is attached, a chamber in the holder, a spring abutment in the chamber, a reduced portion of the valve member being operatively connected to said abutment, a tubular push piece surrounding said reduced portion of the valve member and engaging said abutment, a flange on said push piece, the flange being engageable by said sleeve, the movement of the sleeve being limited by the abutment of the flange with the end surface of the holder and the movement of the valve member being limited by the abutment of the step defined between the valve member and the reduced portion thereof with the end of the push piece.

An example of a fuel injection nozzle in accordance with the invention will now be described with reference to the accompanying drawing which is a sectional side elevation of part of the nozzle.

Referring to the drawing the injection nozzle comprises a stepped nozzle body 10 which is secured in known manner to one end of a nozzle holder 10A by means of a cap nut not shown.

Formed in the nozzle body is a bore 11 which intermediate its ends is provided with an enlargement 12 which is connected by way of a passage 13 to a fuel inlet in the holder. The portion 11A of the bore which is in the narrower portion of the body is of slightly smaller diameter and defines at its end removed from the enlargement, a seating 14 surrounding an outlet 15.

Slidable within the bore 11 is a sleeve 16 in which are formed apertures 17 which extend between the inner and outer peripheral surfaces of the sleeve. Moreover, slidable within the sleeve is a valve member 18 which extends within the narrower portion of the bore and is shaped for co-operation with the seating 14. Moreover, the valve member is provided with an extension 19 which extends with clearance through the outlet 15 and at its opposite end the valve member is provided with a reduced portion 20 upon which is mounted a spring abutment 21 which is engaged with one end of a coiled compression spring 22. The spring and the abutment are located in a chamber formed in the holder.

The end portion of the bore 11 remote from the enlargement 12, is slightly enlarged to accommodate a flange 23 formed at one end of a hollow cylindrical push piece 24 which surrounds the reduced portion 20 of the valve member. The push piece is engaged with the abutment 21 and the flange 23 is engaged by the sleeve 16. In use, when fuel under pressure is supplied to the enlargement the fuel pressure acts upon the sleeve and it also acts upon the differential area of the valve member. When the pressure reaches a sufficiently high value, the force exerted by the spring will be overcome and the valve member and sleeve will move against the action of the spring 22 to allow fuel flow through the outlet 15. The initial movement of the valve is determined by the abutment of the flange 23 with the end surface of the holder and when such abutment occurs no further movement of the sleeve can take place. The valve member can however continue to move as the fuel pressure increases and the movement of the valve member will be determined by the abutment of the step defined between the main portion of the valve member and the reduced portion thereof and the flange. The initial movement of the valve member is limited so that the extension 19 can control the flow of fuel through the outlet 15 to provide a restricted flow of fuel to the associated engine.

It is important to set accurately the initial movement of the valve member and this movement is determined by the gap between the upper surface of the flange 23 and the end surface of the holder 11. If any adjustment of the gap is required this can be effected by grinding the flange 23 or by selective assembly of the push piece and flange. The final position of the valve member, which is not quite so critical, is determined by the gap between the flange and the end face of the body and the gap between the flange and the step on the valve member and this can be varied by grinding the undersurface of the flange or again by selective assembly of the push piece.

The apertures 17 are provided so as to equalize the pressures in the working clearances between the sleeve and the wall of the bore 11 and the valve member 18.

The nozzle as described is of the so-called "pintle" type but the invention is equally applicable to a "hole" type of nozzle in which the initial movement of the valve member provides for restricted flow of fuel between the seating and the valve member.

We claim:

1. A fuel injection nozzle for supplying fuel to an internal combustion engine comprising a valve member of varying diameters, with an abrupt change in diameter defining a step near one end of the valve member, said valve member being slidable axially within a sleeve which is axially slidable in a bore formed in a nozzle body, resilient means engaging a spring abutment mounted on said one end of the valve member, the resilient means being located within a chamber defined in a nozzle holder to which the nozzle body is secured, the resilient means acting to bias the valve member into contact with a seating to prevent flow of fuel from an inlet through an outlet, the valve member and the sleeve being subject to the pressure of fuel at the inlet, a tubular push piece surrounding said reduced portion of the valve member, said push piece at one end being engageable with said spring abutment, a flange at the other end of the push piece, the flange being engageable by said sleeve so that the force developed by the fuel pressure acting on the sleeve will be applied to the spring abutment, the movement of the sleeve being limited by the abutment of a first surface of the flange with an end surface of the nozzle holder and the movement of the valve member being limited by the abutment of the step on said valve member and with a second surface of the flange of the push piece.

* * * * *